US010743597B2

(12) United States Patent
Tong

(10) Patent No.: US 10,743,597 B2
(45) Date of Patent: Aug. 18, 2020

(54) MAGNETIC SELF-ZIPPING ZIPPER WITH DIFFERENT MAGNETIC PULL-IN FORCES

(71) Applicant: Wai Chi Tong, HongKong (CN)

(72) Inventor: Wai Chi Tong, HongKong (CN)

( * ) Notice: Subject to any disclaimer, the term of this patent is extended or adjusted under 35 U.S.C. 154(b) by 0 days.

(21) Appl. No.: 16/167,496

(22) Filed: Oct. 22, 2018

(65) Prior Publication Data

US 2019/0208848 A1 Jul. 11, 2019

(30) Foreign Application Priority Data

Jan. 11, 2018 (HK) ..... 18100368.4

(51) Int. Cl.
*A41F 1/00* (2006.01)
*A44B 19/26* (2006.01)
*A45F 3/00* (2006.01)

(52) U.S. Cl.
CPC ..... *A41F 1/002* (2013.01); *A41F 1/004* (2013.01); *A44B 19/262* (2013.01); *A45F 3/00* (2013.01); *A44D 2203/00* (2013.01)

(58) Field of Classification Search
CPC ..... A41F 1/002; A41F 1/004; A44B 19/262; A44B 19/00; A44D 2203/00; A45F 3/00; A45C 13/1069
See application file for complete search history.

(56) References Cited

U.S. PATENT DOCUMENTS 3,324,521 A * 6/1967 Humiston ..... A41F 1/002 24/303
4,455,719 A * 6/1984 Morita ..... E05C 19/16 24/303
4,480,361 A * 11/1984 Morita ..... A45C 13/1069 24/303
5,604,960 A * 2/1997 Good ..... A41F 1/002 24/303
6,170,131 B1 * 1/2001 Shin ..... A41F 1/002 24/303
6,226,842 B1 * 5/2001 Wong ..... A41F 1/002 24/303
6,378,174 B1 * 4/2002 Wong ..... A41F 1/002 24/303

(Continued)

*Primary Examiner* — Robert Sandy
*Assistant Examiner* — Louis A Mercado
(74) *Attorney, Agent, or Firm* — George G. Wang; Bei & Ocean

(57) ABSTRACT

Disclosed is a magnetic self-zipping zipper with different magnetic pull-in forces. The self-zipping zipper includes magnetic elements arranged in rows, zipper end portions and a zipper intermediate portion. The magnetic element of the zipper end portion has a magnetic force concentrated structure, and the magnetic elements of the zipper intermediate portion including magnetic elements has a magnetic force concentrated structure and magnetic elements with one pole being an iron piece. Advantageous effects thereof are: the self-zipping zipper overcomes the shortcomings of conventional zippers being inconvenient for the elderly and children to pull and close, and provides a magnetic self-zipping zipper that is convenient to wear, washable, stable in pull-in forces, and easy to put on and take off. The magnetic element of the zipper end portion has a magnetic force concentrated structure, which has more stable pull-in forces.

7 Claims, 12 Drawing Sheets

(56) References Cited

U.S. PATENT DOCUMENTS

| | | | | |
|---|---|---|---|---|
| 6,647,597 | B2 * | 11/2003 | Reiter | A41F 1/002 24/303 |
| 8,505,174 | B2 * | 8/2013 | Fildan | A41F 1/002 24/303 |
| 9,131,739 | B1 * | 9/2015 | Sjoquist | A41F 1/002 |
| 9,549,580 | B2 * | 1/2017 | Horton | A41F 1/002 |
| 9,572,386 | B1 * | 2/2017 | Scheer | A41D 11/00 |
| 10,130,130 | B2 * | 11/2018 | Roberman | A44B 1/02 |
| 2001/0014998 | A1 * | 8/2001 | Grunberger | A41F 1/002 24/303 |
| 2005/0177985 | A1 * | 8/2005 | Sjoquist | A41F 1/002 24/104 |
| 2012/0216374 | A1 * | 8/2012 | Manuello | A41F 1/002 24/303 |
| 2014/0143985 | A1 * | 5/2014 | Horton | A41B 1/10 24/303 |
| 2018/0140031 | A1 * | 5/2018 | Fildan | A41F 1/002 |
| 2018/0242667 | A1 * | 8/2018 | Horton | A41D 27/00 |

* cited by examiner

MAGNETIC SELF-ZIPPING ZIPPER WITH DIFFERENT MAGNETIC PULL-IN FORCES

CROSS REFERENCE OF RELATED APPLICATION

This application claims to Application No. HK18100368.4 with a filing date of Jan. 11, 2018. The content of the aforementioned applications, including any intervening amendments thereto, are incorporated herein by reference.

FIELD OF DISCLOSURE

The present disclosure relates to the fields of garments, tents, clothing, handbags, bags and daily necessities, in particular to a magnetic self-zipping zipper with different magnetic pull-in forces.

DESCRIPTION OF RELATED ARTS

Buttons and zippers are common accessories of those items that need to be frequently detached and attached, while zippers are applied more widely due to their better closure performance. As for existing buttons, they require buttonholes to be prepared on the clothing; it is time-consuming to button and unbutton them; they are easily self-released; besides, it is difficult to change their positions. At present, various types of zippers are known, such as plastic, iron, copper, synthetic metal, etc., but they all have a common disadvantage, that is, two sides of an unzipped zipper are in a detached state, such that in many occasions where people should but forget to zip, or the zipper's lock-in head fails and cannot lock, the two sides of the zipper are in a separated state, which causes much inconvenience and embarrassment to people's life and work.

As the elderly age, their actions become slow and clumsy. Some people over the age of 60 may suffer from Parkinson's disease, symptoms of which are mainly hand tremors, stiff postures, and balance disabilities. It is quite troublesome and laborious for the elderly to wear clothes. Because it is already rather difficult for the elderly to lift their arms, pullovers are obviously not a wise choice; but cardigans are. However, buttons or conventional zippers for cardigans are very troublesome for the elderly to button up or zip. It might take 20 minutes for them to put on clothes every day, which would cause anxiety in case of emergency.

At present, a dress is often provided with a zipper at the back. When a woman wears a dress, she needs to move her hands to her back to pull up the zipper, but it is often very inconvenient and difficult to do so. For those with poor flexibility or short hands, it is difficult for them to finish the task of wearing a dress on their own, and it takes a lot of time and effort to put on the dress, which is extremely inconvenient.

Kids often cannot or do not have the patience to fasten and unfasten conventional buttons or zippers; and it is also time-consuming and laborious for the adults to dress them.

In winter, people in cold places always wear gloves and are extremely reluctant to pull out their hands to fasten and unfasten conventional buttons.

Artists or actors need to frequently change clothes for stage performance. For clothes with conventional zippers or buttons, such as working uniforms and protective clothes, it takes a lot of time for artists or actors to put them on; besides, the working uniforms and protective clothing may be hooked by machines or moving objects, posing a danger.

Hence, for clothing for the elderly and the kids, dresses, and those worn in extreme weathers, conventional zippers are inconvenience, time-consuming, and strenuous. Therefore, the present disclosure provides a magnetic self-zipping zipper with different magnetic pull-in forces, which is convenient to use, washable, stable in pull-in force and convenient to put on and take off.

SUMMARY OF THE PRESENT DISCLOSURE

To overcome the drawbacks in the prior art, an object of the present disclosure is to provide a magnetic self-zipping zipper with different magnetic pull-in forces, which is convenient to wear, washable, stable in pull-in forces, and easy to put on and take off. It is especially convenient and fast to use on items that often need to be frequently detached and attached.

The present disclosure provides a magnetic self-zipping zipper with different magnetic pull-in forces, a technical solution of which is provided below:

A magnetic self-zipping zipper having different magnetic pull-in forces, comprising: magnetic elements arranged in rows, the magnetic element comprising an N-pole element and S-pole element engageable with each other, the N-pole element and the S-pole element each comprising a material having an opposite polarity to generate a magnetic pull-in force, such that the N-pole element and the S-pole element are automatically engageable with each other and can be detached from each other when subjected to external forces, an outer surface of each of the N-pole element and the S-pole element is enclosed with a waterproof material; the self-zipping zipper comprises zipper end portions and a zipper intermediate portion, and the magnetic element of the zipper end portion is a magnetic element having a magnetic force concentrated structure, such that the N-pole element and the S-pole element can automatically align with and be firmly fastened to each other during engagement and have greater pull-in forces; the magnetic elements of the zipper intermediate portion include magnetic elements having a magnetic force concentrated structure and magnetic elements with one pole being an iron piece, the magnetic element having a magnetic force concentrated structure is spaced apart from the magnetic element with one pole being an iron piece, and the number of the magnetic elements having a magnetic force concentrated structure accounts for 10%-40% of the number of total magnets of the zipper intermediate portion.

Preferably, the magnetic element having a magnetic force concentrated structure is any one or more selected from the group consisting of a first magnetic element, second magnetic element, third magnetic element, fourth magnetic element, fifth magnetic element and sixth magnetic element, wherein the magnetic element with one pole being an iron piece is a seventh magnetic element and/or eighth magnetic element.

Preferably, the first magnetic element comprises an N-pole element and an S-pole element, the N-pole element or the S-pole element comprising a magnetic ring, a circular iron plate and a protruding portion, the protruding portion being arranged on the circular iron plate, the magnetic ring being sleeved on the protruding portion, and a gap existing between an inner wall of the magnetic ring and an inner wall of the protruding portion.

Preferably, the second magnetic element comprises an N-pole element and an S-pole element, the N-pole element or the S-pole element comprising a magnetic ring, a circular iron plate and a protruding portion, the protruding portion being formed by stamping on a flat circular iron plate, the magnetic ring being sleeved on the protruding portion, a gap existing between an inner wall of the magnetic ring and an inner wall of the protruding portion.

Preferably, the third magnetic element comprises an N-pole element and an S-pole element, the N-pole element or the S-pole element comprising a circular magnetic steel and a disc-shaped iron plate, the disc-shaped iron plate being provided with two notches, the disc-shaped iron plate having an opening in the middle thereof, the circular magnetic steel being provided in the disc-shaped iron plate.

Preferably, the fourth magnetic element comprises an N-pole element and an S-pole element, the N-pole element or the S-pole element comprising a circular magnetic steel and a disc-shaped iron plate, the disc-shaped iron plate being provided with two notches, the circular magnetic steel being a magnetic ring with a hole in the middle thereof, the middle of the disc-shaped iron plate being provided with a cylindrical protrusion, the circular magnetic steel being arranged in the disc-shaped iron plate.

Preferably, the fifth magnetic element comprises an N-pole element and an S-pole element, the N-pole element comprising a circular magnetic steel and a disc-shaped iron plate, the circular magnetic steel being arranged in the disc-shaped iron plate, but having a thickness smaller than the height of a periphery of the disc-shaped iron plate, thereby forming a concave structure after the circular magnetic steel is placed in the disc-shaped iron plate; the S-pole element comprising a circular magnetic steel and a disc-shaped iron plate, but having a height larger than the thickness of the periphery of the disc-shaped iron plate, thereby forming a convex structure after the circular magnetic steel is placed in the disc-shaped iron plate.

Preferably, the sixth magnetic element comprises an N-pole element and an S-pole element, the N-pole element or the S-pole element comprising a square-shaped magnetic steel and an iron grooves with two protruding sides, the square-shaped magnetic steel being disposed in the iron groove with two protruding sides.

Preferably, the seventh magnetic element comprises an N-pole element and an S-pole element, the N-pole element comprising a circular iron piece, the S-pole element comprising a circular magnetic steel and a disc-shaped iron plate, the circular magnetic steel being arranged in the disc-shaped iron plate.

Preferably, the eighth magnetic element comprises an N-pole element and an S-pole element, the N-pole element comprising a square-shaped iron piece; the S-pole element comprising a square-shaped magnetic steel and a square-shaped iron groove, the square-shaped iron groove having two protruding sides, the square-shaped magnetic steel being arranged in the square-shaped iron groove.

The implementation of the present disclosure brings about the following technical effects:

The magnetic self-zipping zipper with different magnetic pull-in forces according to the present disclosure provides a magnetic self-zipping zipper that is convenient to wear, washable, stable in pull-in forces, and easy to put on and take off, so as to overcome the shortcomings of conventional zippers being inconvenient to fasten and unfasten in the elderly's clothing, dresses, children's clothing, and clothes worn in extreme weather, etc., which are time-consuming and laborious to wear. Since both ends of the zipper are easily detachable portions. Hence, the magnetic element defining the zipper end portion has a magnetic force concentrated structure and has a more stable pull-in force. Furthermore, the magnetic element defining the zipper intermediate portion comprises magnetic elements having a magnetic force concentrated structure and magnetic elements with one pole being an iron piece. The number of magnetic elements with a magnetic force concentrated structure accounts for 10%-40% of the number of total magnetic elements of the zipper intermediate portion, wherein the magnetic force of the magnetic element with one pole being an iron piece is relatively low, such that the zipper intermediate portion has moderate pull-in forces, and can be opened quickly when the zipper end portions are pulled open, and the manufacturing cost of the magnetic element with one pole being an iron piece is relatively low; such a zipper structure further reduces the manufacturing cost, has market competitiveness, and is very suitable for extensive use.

The advantageous effects of the present disclosure are that since both sides of the zipper are magnetic materials which have a different polarity and are automatically attracted to each other, both sides of the zipper are in an automatic closure state when the zipper is not locked, which reduces the inconvenience and embarrassment in people's life and work caused by both sides of the zipper being in a separated state. Due to its simple structure and easy usage, it is worth being promoted. When used on items that require frequent separation and joining, such as in the field of garments, tents, clothing, handbags, bags, and daily necessities, the present disclosure provides convenience and quickness.

The self-zipping zipper of the disclosure has the functions of automatic fastening and easy unfastening, and is especially popular among children, the elderly, and people who need to fasten and unfasten an item one-handedly within a short period time; when clothes or protective clothing are accidentally hooked, clothes or work protective clothing that adopt the self-zipping zipper may enable the wearer to escape easily and prevent him from being caught and injured.

This product is easy to use. In daily life, the zippers used by most of the people have to be fastened and unfastened by hand. This product requires neither manual fastening nor manual unfastening. It relies upon magnetic forces for attraction to the magnetic material of the other half of the clothing, and the present zipper will not have loose connection after it is joined to the other side. The present zipper does not have to take a lot of time and effort to unfasten, and it can immediately be pulled open when acted upon by a certain force, which is more convenient for young children. The time for fastening and unfastening has been reduced to less than half of the original time taken to do so. The present zipper is made of metal material enclosed with waterproof material, which is more rugged and durable than ordinary plastic zippers. This product can magnetize the air around the human body and form a small magnetic field around the human body. By magnetizing the metal ions in the air, people can achieve the health care effect after inhaling the magnetized air.

DETAILED DESCRIPTION OF THE PREFERRED EMBODIMENT

The present disclosure will be described in detail below with reference to the embodiments and the accompanying drawings, which are to be understood that the described embodiments are only intended to facilitate the understanding of the present disclosure, and have no limiting function to the present disclosure.

Figure 1A:
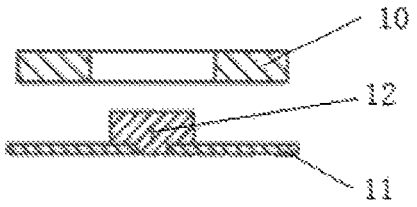
FIG. 1A is a schematic diagram showing the disassembled side structure of an element of any polarity of a first magnetic element according to an embodiment of the present disclosure.
Figure 1B:
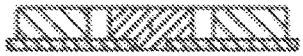
FIG. 1B is a schematic diagram showing the assembled side structure of an element of any polarity of a first magnetic element according to an embodiment of the present disclosure.
Figure 1C:
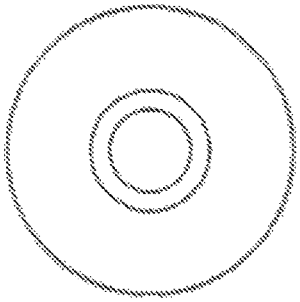
FIG. 1C is a schematic top view showing the assembly of an element of any polarity of a first magnetic element according to an embodiment of the disclosure.
Figure 1D:
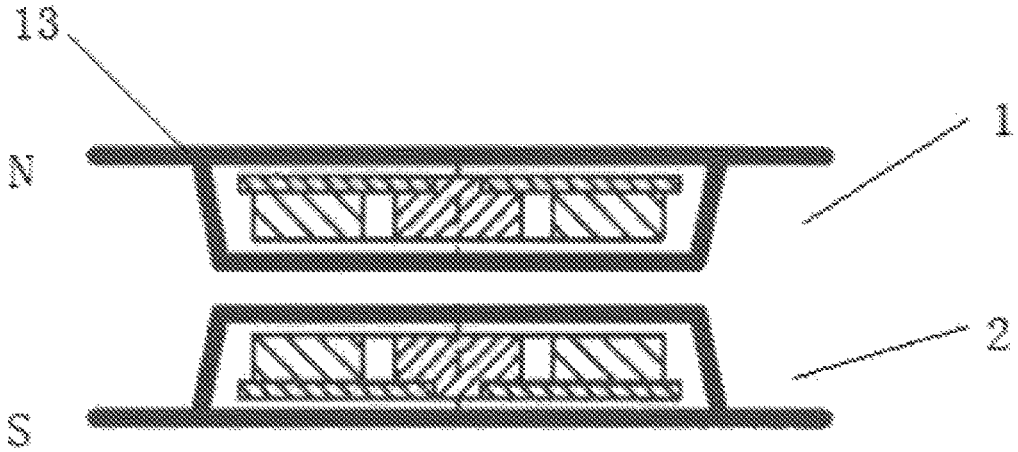
FIG. 1D is a schematic diagram showing the side structure of a first magnetic element according to an embodiment of the present disclosure.
Figure 2A:
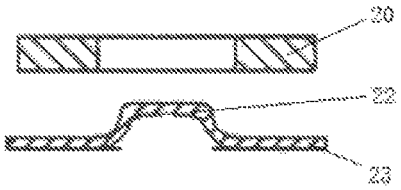
FIG. 2A is a schematic diagram showing the disassembled side structure of an element of any polarity of a second magnetic element according to an embodiment of the present disclosure.
Figure 2B:
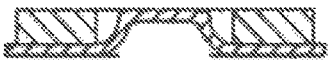
FIG. 2B is a schematic diagram showing the assembled side structure of an element of any polarity of a second magnetic element according to an embodiment of the present disclosure.
Figure 2C:
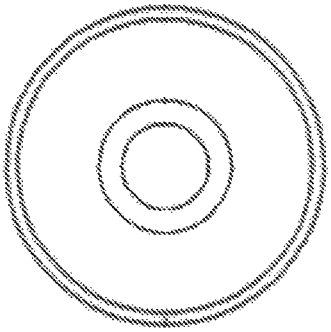
FIG. 2C is a schematic top view showing the assembly of an element of any polarity of a second magnetic element according to an embodiment of the present disclosure.
Figure 2D:
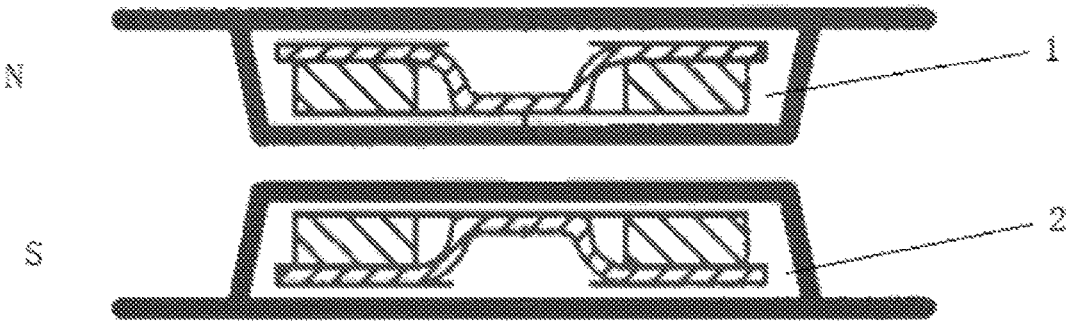
FIG. 2D is a schematic diagram showing the side structure of a second magnetic element according to an embodiment of the present disclosure.
Figure 3A:
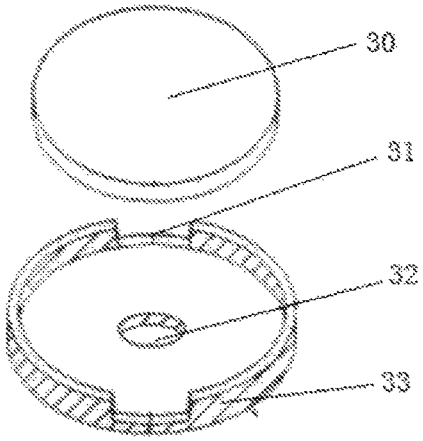
FIG. 3A is a schematic diagram showing the disassembled side structure of an element of any polarity of a third magnetic element according to an embodiment of the present disclosure.
Figure 3B:
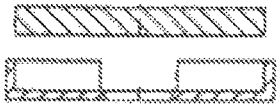
FIG. 3B is a schematic diagram showing the assembled side structure of a third magnetic element according to an embodiment of the present disclosure.
Figure 3C:
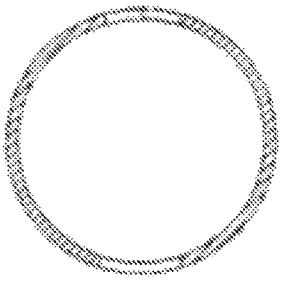
FIG. 3C is a schematic top view showing the assembly of an element of any polarity of a third magnetic element according to an embodiment of the disclosure.
Figure 3D:
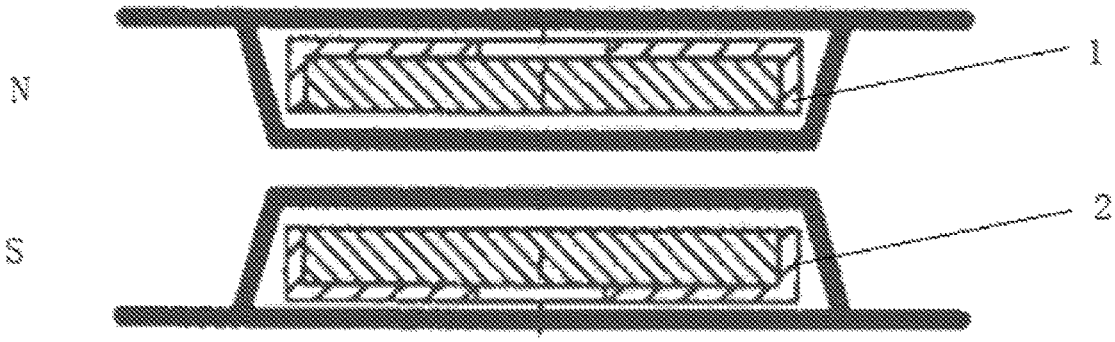
FIG. 3D is a schematic diagram showing the side structure of a third magnetic element according to an embodiment of the present disclosure.
Figure 4A:
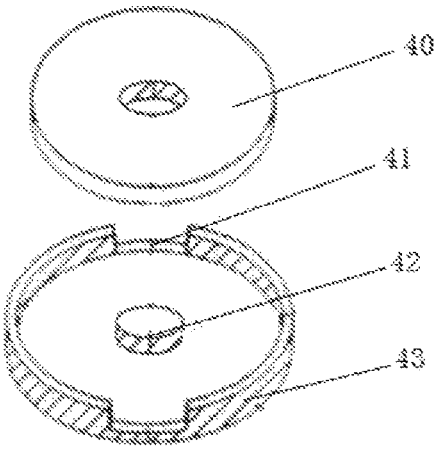
FIG. 4A is a schematic diagram showing the disassembled side structure of an element of any polarity of a fourth magnetic element according to an embodiment of the present disclosure.
Figure 4B:
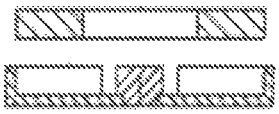
FIG. 4B is a schematic diagram showing the assembled side structure of an element of any polarity of a fourth magnetic element according to an embodiment of the present disclosure.
Figure 4C:
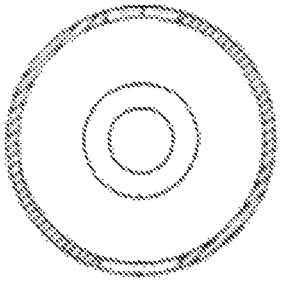
FIG. 4C is a schematic top view showing the assembly of an element of any polarity of a fourth magnetic element according to an embodiment of the disclosure.
Figure 4D:
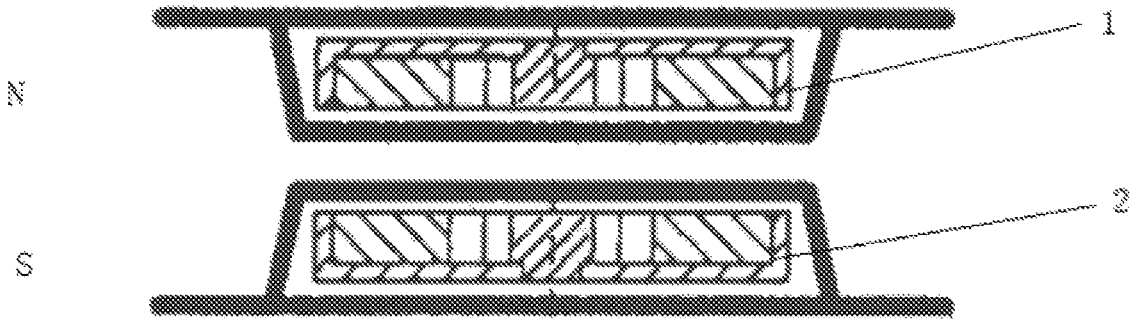
FIG. 4D is a schematic diagram showing the side structure of a fourth magnetic element according to an embodiment of the present disclosure.
Figure 5A:
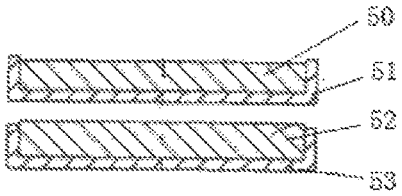
FIG. 5A is a schematic diagram showing the disassembled side structure of a fifth magnetic element according to an embodiment of the present disclosure.
Figure 5B:
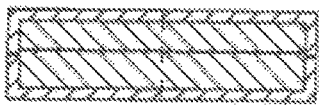
FIG. 5B is a schematic diagram showing the assembled side structure of a fifth magnetic element according to an embodiment of the present disclosure.
Figure 5C:
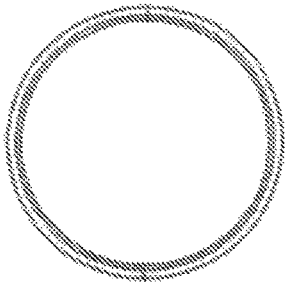
FIG. 5C is a schematic top view showing the assembly of an N-pole element of a fifth magnetic element according to an embodiment of the present disclosure.
Figure 5D:
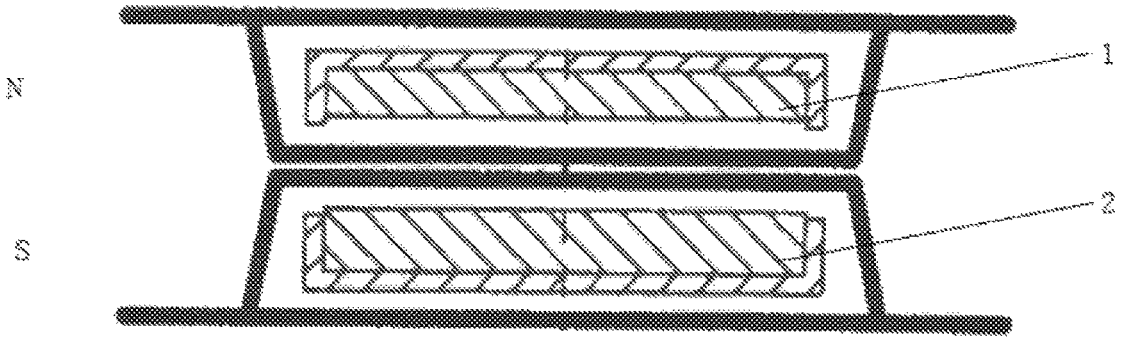
FIG. 5D is a schematic diagram showing the side structure of a fifth magnetic element according to an embodiment of the present disclosure.
Figure 6A:
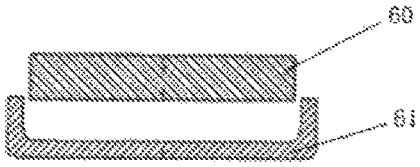
FIG. 6A is a schematic diagram showing the disassembled side structure of an element of any polarity of a sixth magnetic element according to an embodiment of the present disclosure.
Figure 6B:
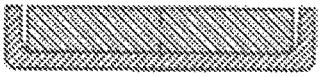
FIG. 6B is a schematic diagram showing the assembled side structure of an element of any polarity of a sixth magnetic element according to an embodiment of the present disclosure.
Figure 6C:
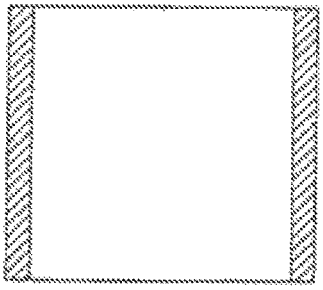
FIG. 6C is a schematic top view showing the assembly of an element of any polarity of a sixth magnetic element according to an embodiment of the disclosure.
Figure 6D:
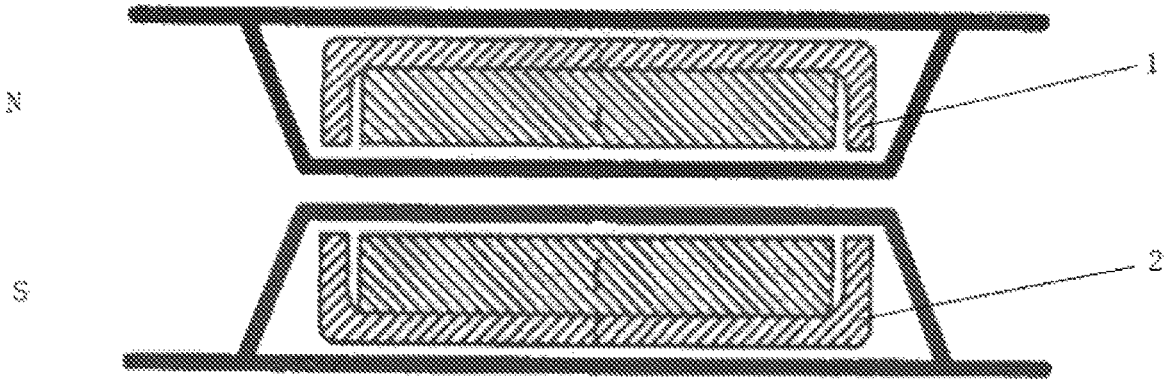
FIG. 6D is a schematic diagram showing the side structure of a sixth magnetic element according to an embodiment of the present disclosure.
Figure 7A:
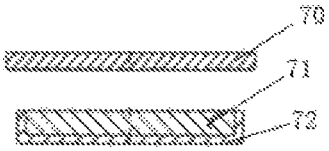
FIG. 7A is a schematic view showing the disassembled side structure of a seventh magnetic element according to an embodiment of the present disclosure.
Figure 7B:
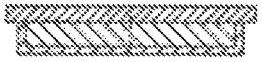
FIG. 7B is a schematic diagram showing the assembled side structure of a seventh magnetic element according to an embodiment of the present disclosure.
Figure 7C:
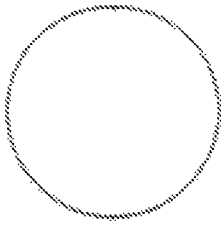
FIG. 7C is a schematic top view showing the assembly of an N-pole element of a seventh magnetic element according to an embodiment of the present disclosure.
Figure 7D:
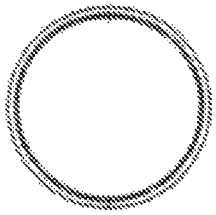
FIG. 7D is a schematic top view showing the assembly of an S-pole element of a seventh magnetic element according to an embodiment of the present disclosure.
Figure 7E:
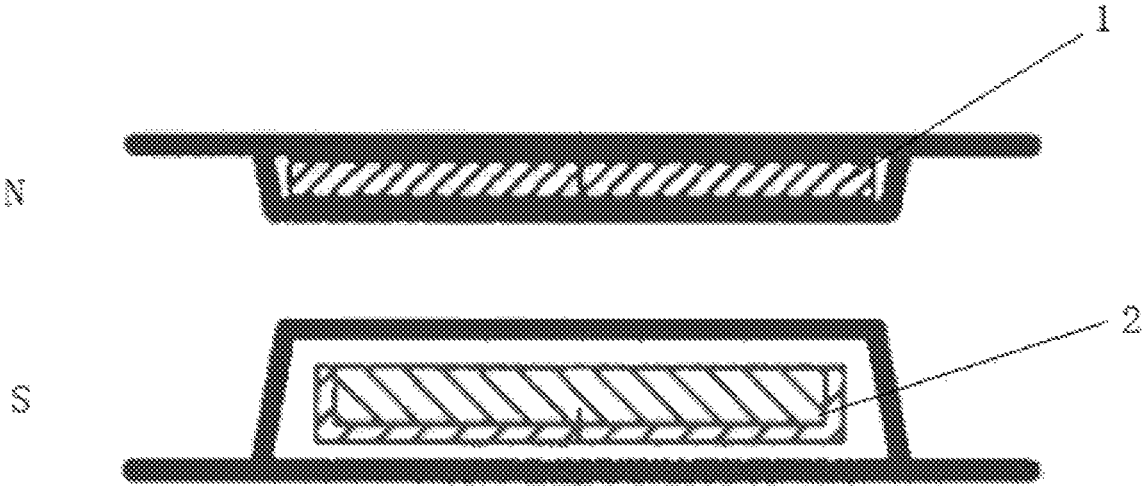
FIG. 7E is a schematic diagram showing the side structure of a seventh magnetic element according to an embodiment of the present disclosure.
Figure 8A:
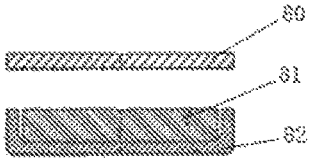
FIG. 8A is a schematic diagram showing the disassembled side structure of an eighth magnetic element according to an embodiment of the present disclosure.
Figure 8B:
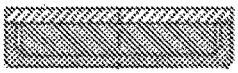
FIG. 8B is a schematic diagram showing the assembled side structure of an eighth magnetic element according to an embodiment of the present disclosure.
Figure 8C:
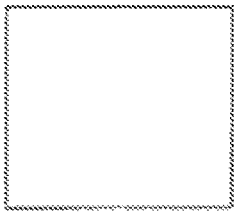
FIG. 8C is a schematic top view showing the assembly of an N-pole element of an eighth magnetic element according to an embodiment of the present disclosure.
Figure 8D:
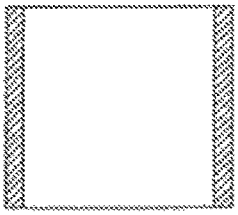
FIG. 8D is a schematic top view showing the assembly of an S-pole element of an eighth magnetic element according to an embodiment of the present disclosure.
Figure 8E:
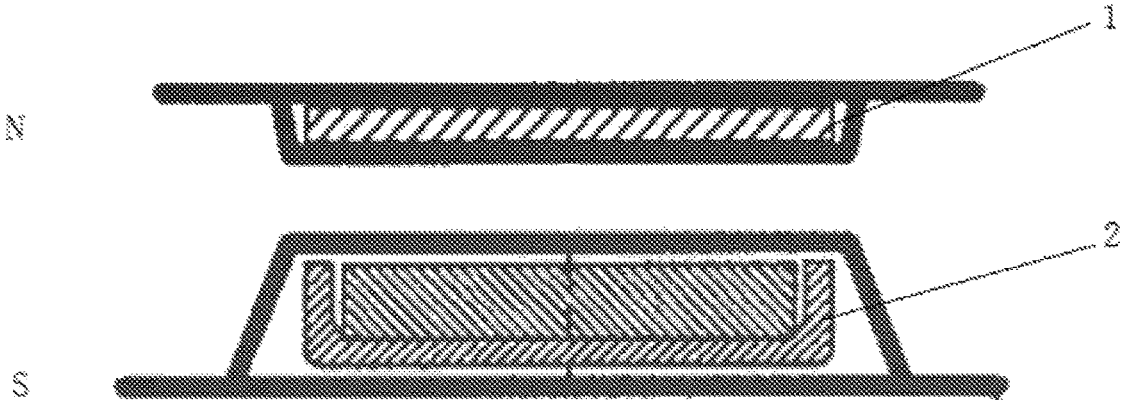
FIG. 8E is a schematic diagram showing the side structure of an eighth magnetic element according to an embodiment of the present disclosure.
Figure 9:
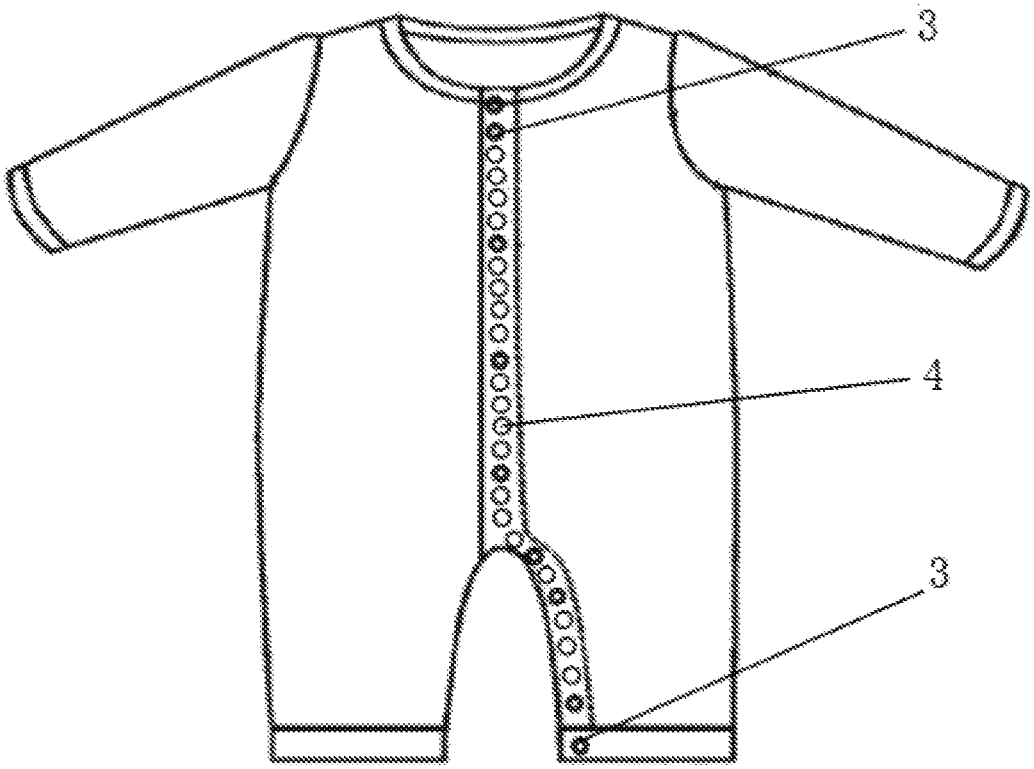
FIG. 9 is a schematic diagram showing a children's garment comprising a magnetic self-zipping zipper having different magnetic pull-in forces according to the present disclosure.
Figure 10:
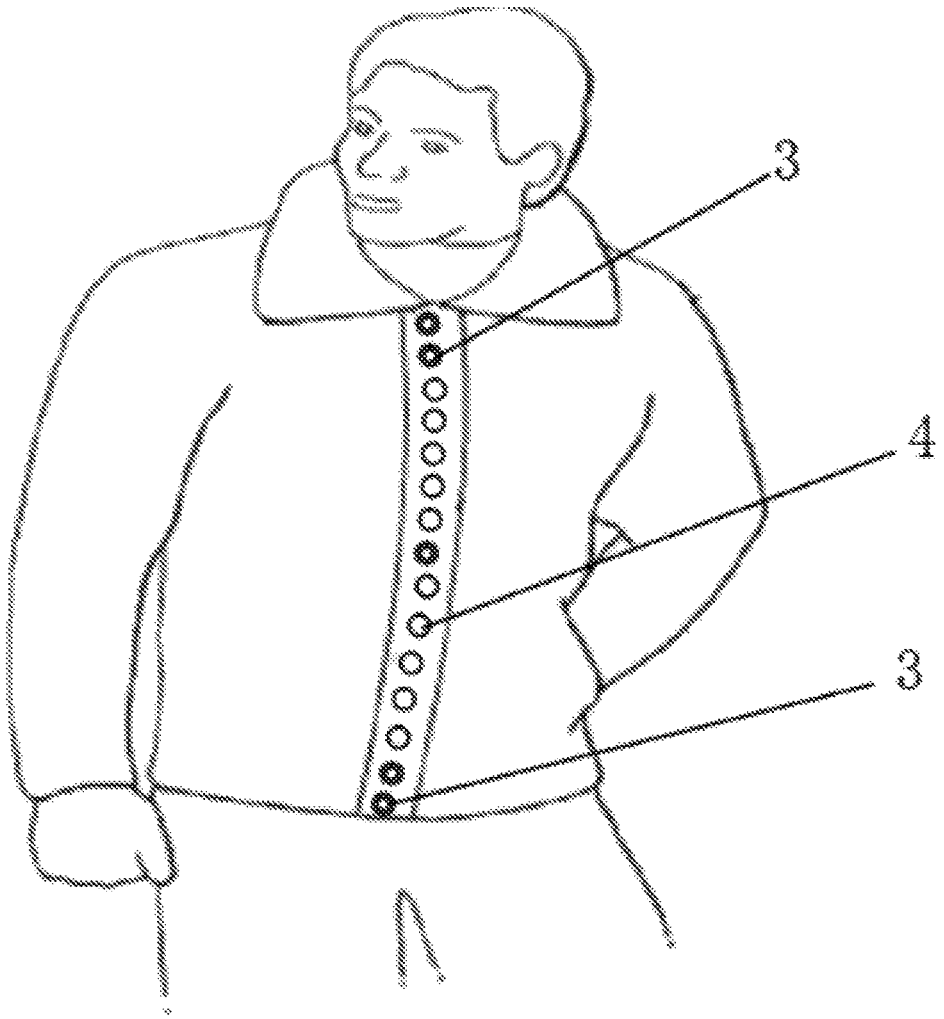
FIG. 10 is a schematic diagram showing an adult's garment comprising a magnetic self-zipping zipper having different magnetic pull-in forces according to the present disclosure.
Figure 11A:
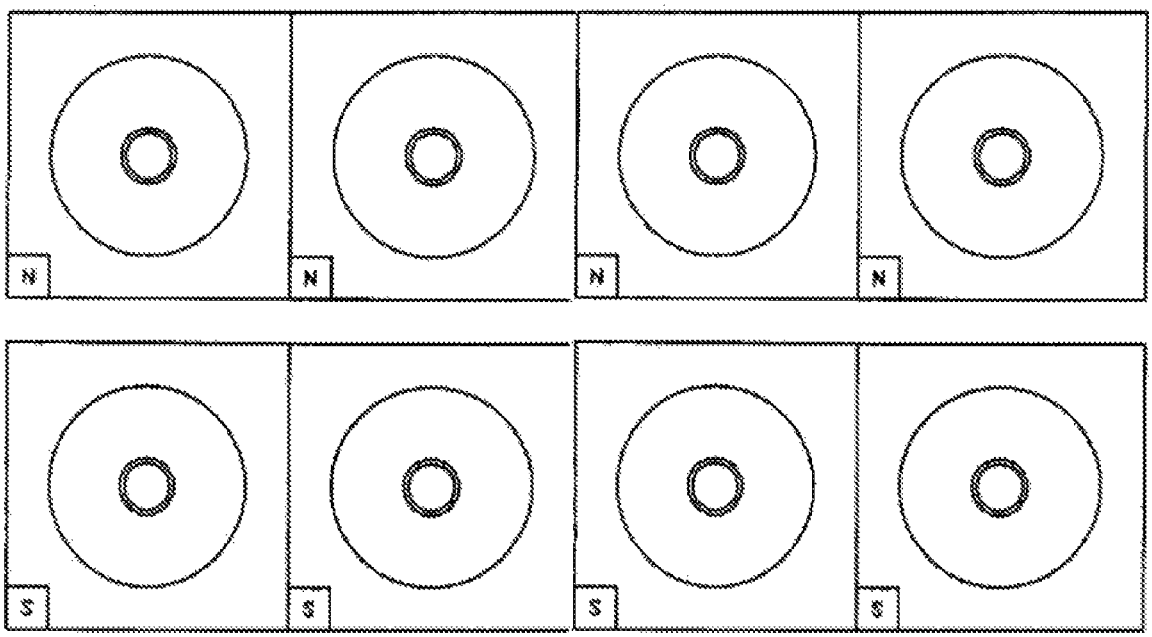
FIG. 11A is a schematic diagram showing one kind of magnetic self-zipping zippers.
Figure 11B:
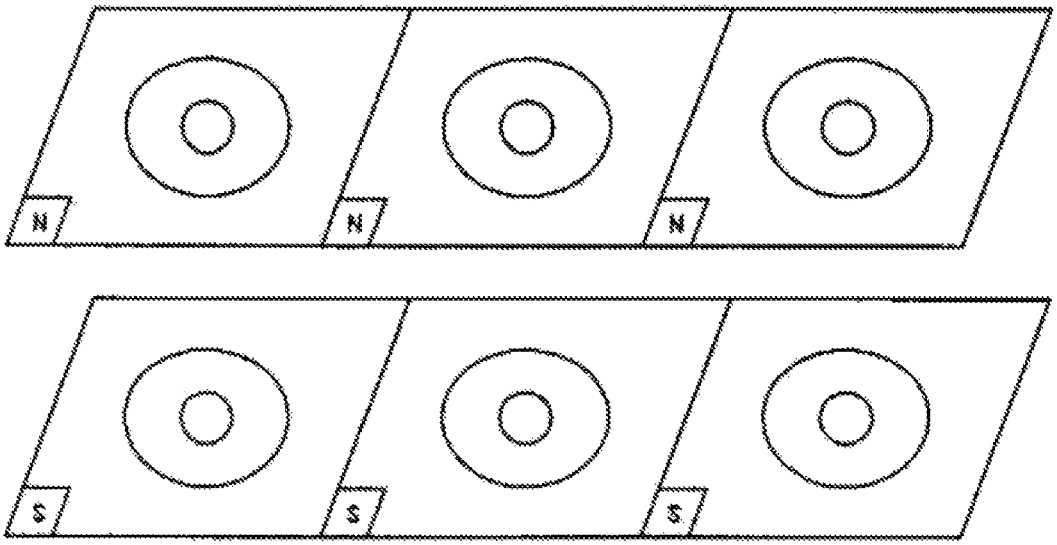
FIG. 11B is a schematic diagram showing another kind of magnetic self-zipping zippers (short zipper).
Figure 11C:
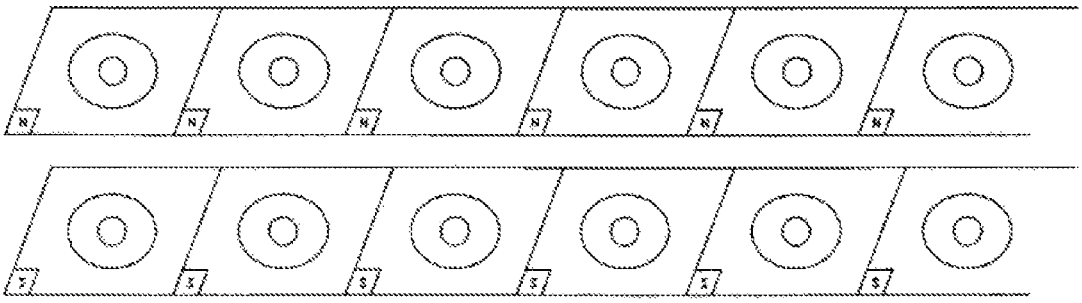
FIG. 11C is a schematic diagram showing a magnetic self-zipping zipper (long zipper) according to the present disclosure.

As shown in FIG. 9 to FIG. 11, the embodiment provides a magnetic self-zipping zipper with different magnetic pull-in forces, and FIG. 9 is a schematic diagram of a children's garment with a magnetic self-zipping zipper having different magnetic pull-in forces according to the embodiment. FIG. 10 is a schematic diagram showing an adult's garment comprising a magnetic self-zipping zipper having different magnetic pull-in forces according to the embodiment. FIG. 11A is a magnetic zipper structure in which the N-pole elements and S-pole elements engageable with each other are perpendicular to each other, and FIG. 11B is a short zipper structure in which the N-pole elements and S-pole elements engageable with each other have a certain inclination, and FIG. 11B is a long zipper structure in which the N-pole elements and S-pole elements engageable with each other have a certain inclination, wherein the N-pole element is equivalent to the positive electrode (+) and the S-pole is equivalent to the negative electrode (−). It should be noted that FIG. 9, FIG. 10 and FIG. 11 are only schematic diagrams for better understanding of the present disclosure. The self-zipping zipper of the embodiment comprises magnetic elements arranged in rows, the magnetic element comprising an N-pole element and S-pole element engageable with each other, the N-pole element and the S-pole element each comprising a material having an opposite polarity to generate a magnetic pull-in force, such that the N-pole element and the S-pole element are automatically engageable with each other and can be detached from each other when subjected to external forces; the outer surface of each of the N-pole element and the S-pole element is enclosed with waterproof material; the self-zipping zipper includes zipper end portions and a zipper intermediate portion; the magnetic element of the zipper end portion is a magnetic element 3 having a magnetic force concentrated structure, such that the N-pole element and the S-pole element can be automatically aligned with and fastened to each other when engaged with each other, and have greater pull-in forces; the magnetic element of the zipper intermediate portion comprises a magnetic element 3 having a magnetic force concentrated structure and a magnetic element 4 with one pole being an iron piece, and the magnetic element 3 having a magnetic force concentrated structure is spaced apart from the magnetic element 4 with one pole being an iron piece; the number of magnets 3 having a magnetic force concentrated structure accounts for 10% to 40%, preferably 20%, of the number of total magnets in the zipper intermediate portion, and the limitation of the above values enables even better performance of the zipper; the magnetic element 3 having a magnetic force concentrated structure is any one or more selected from the group consisting of a first magnetic element, second magnetic element, third magnetic element, fourth magnetic element, fifth magnetic element and sixth magnetic element, wherein the magnetic element 4 with one pole being an iron piece is a seventh magnetic element and/or eighth magnetic element. The magnetic force concentrated structure may be an intermediate protruding portion of the magnetic element, a raised curve shape on a side of the magnetic element, a concave-convex structure of different polarities of the magnetic element or a protruding portion of a side of the magnetic element. The advantageous effects thereof are that it functions to fasten automatically, eliminating the original trouble that it is necessary to use hand to pull up and fasten the conventional zippers. The zipper is preferably formed by hot pressing of PVC waterproof material, and is suitable for use in clothing, bags, tents, etc. because of the convenience of use. The magnetic zipper is used in strips, and can also be cut into a single set, which can also be applied to clothing, bags, gloves, binders, etc. If one wants to use it separately, one only needs to make a set consisting of N-pole and S-pole magnets.

The magnetic self-zipping zipper with different magnetic pull-in forces provided by the embodiment provides a magnetic self-zipping zipper that is convenient to wear, washable, stable in pull-in forces, and easy to put on and take off, so as to overcome the shortcomings of conventional zippers being inconvenient to pull and close in the elderly's clothing, dresses, children's clothing, and clothing worn in extreme weather, etc., having a lot of inconveniences, and being time-consuming and laborious to wear. Since both ends of the zipper are easily detachable portions. Hence, the magnetic element defining the zipper end portion has a magnetic force concentrated structure and has more stable pull-in forces. Furthermore, the magnetic element defining the zipper intermediate portion comprises a magnetic element 3 having a magnetic force concentrated structure and a magnetic element 4 with one pole being an iron piece; the number of magnetic elements 3 having a magnetic force concentrated structure accounts for 10% to 40% of the number of total magnetic elements in the zipper intermediate portion, wherein the magnetic force of the magnetic element 4 with one pole being an iron piece is relatively low, such that the zipper intermediate portion has moderate pull-in forces, and can be opened quickly when the zipper end portions are pulled open, and the manufacturing cost of the magnetic element 4 with one pole being an iron piece is relatively low; such a zipper structure further reduces the manufacturing cost, has market competitiveness, and is very suitable for use extensively.

Referring to FIGS. 1A-1D, the first magnetic element structure of the present embodiment comprises an N-pole element 1 and an S-pole element 2; the N-pole element 1 and the S-pole element 2 are identical structures; and the N-pole element 1 and S-pole element 2 each comprise a magnetic ring 10, a circular iron plate 11, a protruding portion 12, and a waterproof sealing material 13; the protruding portion 12 is disposed on the circular iron plate 11; the magnetic ring 10 is sleeved on the protruding portion 12; an inner wall of the magnetic ring 10 has a gap with an inner wall of the protruding portion 12; after extensive experiments and researches, the ratio of the size of the gap to the diameter of the protruding portion 12 is 4-10, preferably 5; the waterproof sealing material 13 encloses the magnetic ring 10, the circular iron plate 11 and the protruding portion 12. Since the protruding portion 12 can concentrate the magnetic forces of the magnetic ring 10 at the position of the protruding portion 12 (magnetic force concentrated structure), the magnetic forces at the back are weakened; when the N-pole element 1 and the S-pole element 2 engage with each other, they can immediately be aligned with and fastened to each other automatically, without misalignment, which is extremely convenient for use. When one desires to unfasten, simply pulling down the entire zipper will do. The N-pole element 1 and S-pole element 2 each are made of PVC waterproof material by hot pressing, which are excellent in waterproofing.

Referring to FIGS. 2A-2D; the second magnetic element structure of the present embodiment comprises an N-pole element 1 and an S-pole element 2; the N-pole element 1 and the S-pole element 2 are identical structures; the N-pole element 1 and the S-pole element 2 each comprise a magnetic ring 20; a circular iron plate 23; a protruding portion 22; and a waterproof sealing material; the protruding portion 22 is formed by punching on a flat circular iron plate 23; the magnetic ring 20 is sleeved on the protruding portion 22; an inner wall of the magnetic ring 20 has a gap with an inner wall of the protruding portion 22; after extensive experiments and researches; the ratio of the size of the gap to the diameter of the protruding portion 22 is 4-10; preferably 5; the waterproof sealing material encloses the magnetic ring 20; the circular iron plate 23 and the protruding portion 22. Since the protruding portion 22 (magnetic force concentrated structure) can concentrate the magnetic forces of the magnetic ring 20 at the position of the protruding portion 22; the magnetic forces at the back are weakened. When the N-pole element 1 and the S-pole element 2 engage with each other, they can immediately be aligned with and fastened to each other automatically, without misalignment, which is extremely convenient for use. When one desires to unfasten, simply pulling down the entire zipper will do. The N-pole element 1 and the S-pole element 2 each are made of PVC or other waterproof materials by hot pressing, which are excellent in waterproofing.

Referring to FIGS. 3A-3D, the third magnetic element structure of the present embodiment comprises an N-pole element 1 and an S-pole element 2; the N-pole element 1 and the S-pole element 2 are identical structures; the N-pole element 1 and the S-pole element 2 each comprise a circular magnetic steel 30 and a disc-shaped iron plate 33; the disc-shaped iron plate 33 is provided with two notches 31, preferably two symmetrically arranged notches 31. The disc-shaped iron plate 33 has an opening 32 in the middle for facilitating pin insertion and removal of the magnetic steel, and the circular magnetic steel 30 is disposed in the disc-shaped iron plate 33. The function of the notch 31 is to divide the raised periphery of the outer edge of the disc-shaped iron plate 33 into two arc shapes, and the function of the two raised arc shapes (magnetic force concentrated structure) is to concentrate the magnetic forces of the circular magnetic steel 30 on the two raised arc shapes. When the N-pole element 1 and the S-pole element 2 engage with each other, the arc shapes on both sides will align with and fasten to each other automatically, without misalignment, which is extremely convenient. The N-pole elements 1 and the S-pole elements 2 are also formed from PVC or any waterproof material by hot pressing, forming a complete row of magnetic zipper. It can also be cut into a pair of N-pole element 1 and S-pole element 2, and used separately.

Referring to FIGS. 4A-4D, the fourth magnetic element structure of the present embodiment comprises an N-pole element 1 and an S-pole element 2; the N-pole element 1 and the S-pole element 2 are identical structures; the N-pole element 1 and the S-pole element 2 each comprise a circular magnetic steel 40 and a disc-shaped iron plate 43; the disc-shaped iron plate 43 is provided with two notches 41, preferably two symmetrically arranged notches 41. The circular magnetic steel 40 is a magnetic ring with a hole in the middle, and the middle of the disc-shaped iron plate 43 is a cylindrical protrusion 42. The function of the protrusion 42 (magnetic force concentrated structure) is to concentrate magnetic forces to increase the magnetic forces. The circular magnetic steel 40 is disposed in the disc-shaped iron plate 43. The function of the notch 41 is to divide the periphery of the disc-shaped iron plate 43 into two arc shapes, and the function of the two arc shapes is to concentrate the magnetic forces of the circular magnetic steel 40 on the two arc shapes (magnetic force concentrated structure). When the N-pole element 1 and the S-pole element 2 engage with each other, the arc shapes on both sides will align with and fasten to each other automatically, without misalignment, which is extremely convenient. The N-pole elements 1 and the S-pole elements 2 are also formed from PVC or any waterproof material by hot pressing, forming a complete row of magnetic zipper. It can also be cut into a pair of N-pole element 1 and S-pole element 2, and used separately.

Referring to FIGS. 5A-5D, the fifth magnetic element structure of the present embodiment comprises an N-pole element 1 and an S-pole element 2, and the N-pole element 1 and the S-pole element 2 are different structures; the N-pole element 2 comprises a circular magnetic steel 50 and a disc-shaped iron plate 51, the circular magnetic steel 50 is disposed in the disc-shaped iron plate 51, but the thickness of the circular magnetic steel 50 is lower than the height of the periphery of the disc-shaped iron plate 51, forming a concave structure after the circular magnetic steel 50 is placed in disc-shaped iron plate 51; the S-pole element 1 comprises a circular magnetic steel 52 and a disc-shaped iron plate 53; the circular magnetic steel 52 is disposed in the disc-shaped iron plate 53, but the height of the circular magnetic steel 52 is higher than the height of the periphery of the disc-shaped iron plate 53, forming a convex structure after the circular magnetic steel 52 is placed in the disc-shaped iron plate 53. When the N-pole element 1 and the S-pole element 2 are assembled, due to the action of the concavity and convexity (magnetic force concentrated structures), the N-pole element 1 and the S-pole element 2 generate lateral pulling forces when tightly pulled towards and engaged with each other, and the magnetic forces are concentrated, such that the N-pole element 1 and the S-pole element 2 produce a tight snap to prevent lateral detachment, making the entire magnetic zipper more stable. It is more convenient and appropriate if it is cut and used alone. The N-pole element 1 and the S-pole element 2 are also formed from PVC or any waterproof material by hot pressing, and are washable.

Referring to FIGS. 6A-6D, the sixth magnetic element structure of the present embodiment comprises an N-pole element 1 and an S-pole element 2; the N-pole element 1 and the S-pole element 2 are identical structures; the N-pole element 1 comprises a square-shaped magnetic steel 60 and iron grooves 61 protruding on both sides; the square-shaped magnetic steel 60 is disposed in the iron grooves 61 protruding on both sides, and functions to concentrate the magnetic forces of the square-shaped magnetic steel 60 on the protruding portions of the iron grooves 61 (magnetic force concentrated structure)), the magnetic forces at the back side will be weakened. When the N-pole element 1 and the S-pole element 2 are engaged with each other, the protruding portion functions to automatically align and fasten tightly. The N-pole element 1 and the S-pole element 2 are also formed from PVC or any waterproof material by hot pressing, and are washable.

Referring to FIGS. 7A-7E, the seventh magnetic element structure of the present embodiment comprises an N-pole element 1 and an S-pole element 2; the N-pole element 1 and the S-pole element 2 are different structures; the N-pole element 1 comprises a circular iron piece 70; the S-pole element 2 comprises a circular magnetic steel 71 and a disc-shaped iron plate 72; the circular magnetic steel 71 is disposed in the disc-shaped iron plate 72. After the circular magnetic steel 71 is placed in the disc-shaped iron plate 72, magnetic forces can be concentrated, and the circular iron piece 70 can be easily pulled-in tightly, which can save half of the magnetic steel material but still plays the same role. When the N-pole element 1 (circular iron piece 70) forms a magnetic zipper by hot pressing with PVC or other waterproof material, a separate pair cut from said magnetic zipper may likewise be used.

Referring to FIGS. 8A-8E, the eighth magnetic element structure of the present embodiment comprises an N-pole element 1 and an S-pole element 2; the N-pole element 1 and the S-pole element 2 are different structures; the N-pole element 1 comprises a square-shaped iron piece 80; the S-pole element 2 comprises a square-shaped magnetic steel 81 and a square-shaped iron groove 82; the square-shaped iron groove 82 has protrusions on both sides thereof; the square-shaped magnetic steel 81 is disposed in the square-shaped iron groove 82; after the square-shaped magnetic steel 81 is placed in the square-shaped iron groove 82, the magnetic forces of the magnetic steel will be concentrated on the protruding portions on both sides, which can easily pull in the square-shaped iron piece 80 tightly; thus, the N-pole element 1 (square-shaped iron piece 80) and the S-pole element 2 respectively form a magnetic zipper by hot pressing with PVC or other waterproof material, a separate pair cut from said magnetic zipper may likewise be used.

The product provided by the embodiment is convenient to use. In daily life, the zippers used by most of the people have to be fastened and unfastened by hand. This product requires neither manual fastening nor manual unfastening. It relies upon magnetic forces for attraction to the magnetic material of the other half of the clothing, and the present zipper will not have loose connection after it is joined to the other side. The present zipper does not have to take a lot of time and effort to unfasten, and it can immediately be pulled open when acted upon by a certain force, which is more convenient for young children. The time for fastening and unfastening has been reduced to less than half of the original time taken to do so. The present zipper is made of metal material enclosed with waterproof material, which is more rugged and durable than ordinary plastic zippers. This product can magnetize the air around the human body and form a small magnetic field around the human body. By magnetizing the metal ions in the air, people can achieve the health care effect after inhaling the magnetized air. When used on items that require frequent separation and joining, such as in the field of garments, tents, clothing, handbags, bags, and daily necessities, the present disclosure provides convenience and quickness.

Lastly, it should be noted that the above embodiments are only intended to illustrate the technical solutions of the present disclosure, and are not intended to limit the scope of the present disclosure. Although the present disclosure is described in detail with reference to the preferred embodiments, those skilled in the art should understand that modifications to or equivalent replacements of the technical solutions of the present disclosure may be made without departing from the spirit and scope of the technical solutions of the present disclosure.

What is claimed is:

1. A magnetic self-zipping zipper comprising a first end portion, a second end portion and a middle portion along a longitudinal direction of the zipper, and comprising a plurality of magnetic elements of a first type magnetic element and a second type magnetic element, being arranged in a row along the longitudinal direction of the zipper, with the first type magnetic element having a greater pull-in force than the second type magnetic element, wherein the first end portion and the second end portion of the zipper each have at least one of the first type magnetic element but have none of the second type magnetic element, while the middle portion of the zipper comprises both the first type magnetic elements and the second type magnetic elements with 10%-40% of the magnetic elements being the first type and 60%-90% being the second type, wherein each of the magnetic elements comprises two pole elements: a N-pole element and an S-pole element, and the first type magnetic element comprises two pole elements each of which is a magnetic force concentrated structure of a predetermined design and the second type magnetic element comprises a pole element which is an iron piece, and wherein each of the N-pole element and the S-pole element of the first type magnetic element comprises a magnetic ring, a circular iron plate and a protruding portion, the protruding portion being formed by punching on the circular iron plate, the magnetic ring being sleeved on the protruding portion, an inner wall of the magnetic ring has a gap with an outer wall of the protruding portion.

2. The magnetic self-zipping zipper according to claim 1, wherein each of the N-pole element and the S-pole element of the first type magnetic element comprises a circular magnetic steel and a disc-shaped iron plate, the disc-shaped iron plate being provided with two notches, the disc-shaped iron plate having an opening in a middle thereof, the circular magnetic steel being provided in the disc-shaped iron plate.

3. The magnetic self-zipping zipper according to claim 1, wherein each of the N-pole element and the S-pole element of the first type magnetic element comprises a circular magnetic steel and a disc-shaped iron plate, the disc-shaped iron plate being provided with two notches, the circular magnetic steel being a magnetic ring with a hole in a middle thereof, the middle of the disc-shaped iron plate being provided with a cylindrical protrusion, the circular magnetic steel being arranged in the disc-shaped iron plate.

4. The magnetic self-zipping zipper according to claim 1, wherein the N-pole element of the first type magnetic element comprises a circular magnetic steel and a disc-shaped iron plate, the circular magnetic steel being provided in the disc-shaped iron plate, but a thickness of the circular magnetic steel being lower than a height of a periphery of the disc-shaped iron plate, forming a concave structure after the circular magnetic steel is placed in the disc-shaped iron plate; and the S-pole element of the first type magnetic element also comprises a circular magnetic steel and a disc-shaped iron plate, the circular magnetic steel being provided in the disc-shaped iron plate, but a height of the circular magnetic steel being higher than a thickness of a periphery of the disc-shaped iron plate, forming a convex structure after the circular magnetic steel is placed in the disc-shaped iron plate.

5. The magnetic self-zipping zipper according to claim 1, wherein each of the N-pole element and the S-pole element of the first type magnetic element comprises a square-shaped magnetic steel and a square-shaped iron groove, the square-shaped iron groove having a protrusion on both side, the square-shaped magnetic steel being disposed in the square-shaped iron groove.

6. The magnetic self-zipping zipper according to claim 1, wherein the N-pole element of the second type magnetic element comprises a circular iron piece, and the S-pole element of the second type magnetic element comprises a circular magnetic steel and a disc-shaped iron plate, the circular magnetic steel being arranged in the disc-shaped iron plate.

7. The magnetic self-zipping zipper according to claim 1, wherein the N-pole element of the second type magnetic element comprises a square-shaped iron piece, and the S-pole element of the second type magnetic element comprises a square-shaped magnetic steel and a square-shaped iron groove, the square-shaped iron groove having a protrusion on both sides, the square-shaped magnetic steel being disposed in the square-shaped iron groove.

* * * * *